US006283103B1

(12) United States Patent
Hoeflich

(10) Patent No.: US 6,283,103 B1
(45) Date of Patent: Sep. 4, 2001

(54) METHODS AND APPARATUS FOR CONTROLLING SPARK DURATION IN AN INTERNAL COMBUSTION ENGINE

(75) Inventor: Gary R. Hoeflich, Roscoe, IL (US)

(73) Assignee: Woodward Governor Company, Rockford, IL (US)

( * ) Notice: Subject to any disclaimer, the term of this patent is extended or adjusted under 35 U.S.C. 154(b) by 0 days.

(21) Appl. No.: 09/291,570

(22) Filed: Apr. 13, 1999

Related U.S. Application Data

(60) Provisional application No. 60/081,561, filed on Apr. 13, 1998.

(51) Int. Cl.[7] ..... F02P 3/06

(52) U.S. Cl. ..... 123/596; 123/644; 315/212

(58) Field of Search ..... 123/596, 598, 123/644, 609; 315/212, 209 CD

(56) References Cited

U.S. PATENT DOCUMENTS

| | | | | |
|---|---|---|---|---|
| 3,906,919 | | 9/1975 | Asik | 123/148 E |
| 4,022,177 | | 5/1977 | Canup | 123/148 E |
| 4,149,508 | * | 4/1979 | Kirk et al. | 123/148 CB |
| 4,231,348 | | 11/1980 | Schiele | 123/644 |
| 4,406,273 | | 9/1983 | Yoshinaga | 123/625 |
| 4,414,954 | | 11/1983 | Canup | 123/606 |
| 4,631,451 | | 12/1986 | Anderson | 315/209 R |
| 4,913,123 | * | 4/1990 | DeBiasi et al. | 123/609 |
| 5,054,461 | * | 10/1991 | Deutsch et al. | 123/609 |
| 5,056,496 | | 10/1991 | Morino | 123/604 |
| 5,060,623 | | 10/1991 | McCoy | 123/605 |
| 5,208,540 | | 5/1993 | Hoeflich . | |
| 5,334,938 | | 8/1994 | Kugler | 324/399 |
| 5,337,717 | | 8/1994 | Scheel | 123/426 |

* cited by examiner

*Primary Examiner*—Henry C. Yuen
*Assistant Examiner*—Mahmoud Gimie
(74) *Attorney, Agent, or Firm*—Leydig, Voit & Mayer, Ltd.

(57) ABSTRACT

An ignition system, of the type having ignition coils supplying energy to spark plugs in an internal combustion engine, includes apparatus to measure an electrical characteristic indicative of spark duration and generate a representative spark duration signal therefrom, or alternately to directly measure spark duration and generate a representative spark duration signal. Computational circuitry receives the spark duration signal and a spark duration setpoint signal, computes the error between the setpoint and the actual spark duration on a real-time basis, and modulates the energy in the high energy power supply to the ignition coils for maintaining a constant spark duration.

20 Claims, 11 Drawing Sheets

METHODS AND APPARATUS FOR CONTROLLING SPARK DURATION IN AN INTERNAL COMBUSTION ENGINE

This application claims benefit of provisional application No. 60/081,561 Apr. 13, 1998.

TECHNICAL FIELD

The present invention relates generally to ignitions systems such as used with internal combustion engines, and more particularly, to control of spark duration in such ignitions systems.

BACKGROUND OF THE INVENTION

Capacitance discharge (CD) ignition systems are widely used in internal combustion engines, such as in automotive and industrial applications, to provide energy to the engine spark plugs. The construction and operation of conventional capacitance discharge systems is well known, and is discussed only briefly herein for an understanding and appreciation of the present invention.

A conventional capacitance discharge ignition system typically includes sensors such as variable reluctance sensors that provide signals indicative of crankshaft position relative to top dead center (TDC) of the #1 cylinder and engine speed, an electric power source, means to convert the supply voltage from the power source to a relatively high voltage, a capacitor to store energy from the power source, means to control the voltage on the energy storage capacitor, and timing means to process information from the sensors to determine when the stored energy should be discharged into an ignition coil for delivery to a spark plug.

Conventional capacitance discharge ignition systems are designed to deliver a fixed amount of energy to each spark plug to achieve a spark duration that will ignite the air/fuel mixture in the engine cylinder and sustain the flame for the desired combustion. However, it is well known that spark plug electrodes erode over a period of time, and that the energy needed for a desired spark duration increases as the spark plug erodes. Therefore, the energy delivered to the plugs in conventional ignition systems is set at a relatively high level to ensure that there is sufficient spark duration available to ignite the air/fuel mixture in the cylinder as the spark plug electrodes erodes within pre-defined limits. Unfortunately, delivering energy at a level that is higher than necessary to achieve the desired spark duration for the desired combustion has the effect of accelerating the spark plug erosion, and thus reducing the useful life of the spark plugs.

Another consideration in establishing the operating parameters of conventional ignition systems is the fact that the voltage required to ionize the fuel/air mixture between the electrodes of a spark plug changes as fuel/air mixture changes. As a result, conventional ignition systems are set to deliver excess energy to the spark plugs for anticipated worst-case operating conditions. This results in excessive spark plug erosion at operating conditions less than worst-case, further reducing the useful life of the spark plugs.

The consequences and costs associated with engine downtime to replace worn spark plugs, and the costs associated with the inefficiencies of operating spark plugs at less than the desired or optimal conditions is of particular concern in connection with engines that are utilized in industrial-type applications where the engines may be operating continuously for long periods of time. In fact, in many instances, the engines are intended to operate continuously except for repair-time. In addition to the fact that continuous operation logs substantial hours of operation relatively quickly, as compared with, for example, normal automotive uses, the useful life of spark plugs in some industrial engines are in the neighborhood of only hundreds of hours. In such instances, the losses and costs associated with operating the engine with a conventional ignition system adapted to provide excess energy to the spark plugs are quite substantial.

SUMMARY OF THE INVENTION

The general aim of the present invention is to increase the useful life of spark plugs in an ignition system by providing means for delivering sufficient, but not excess, energy to insure sufficient spark duration for proper ignition of the fuel/air mixture.

A detailed objective is to achieve the foregoing by providing means to measure and/or compute the actual spark duration on a per spark plug basis, and means for modulating the energy delivered to each spark plug independently so as to achieve the desired spark duration. With such an arrangement, an ignition system according to present invention substantially reduces spark plug erosion and the inefficiencies associated with operating an engine at less than optimal conditions, thus, extending the useful life of the spark plugs in the ignition system, and reducing the costs and engine downtime associated with frequent replacement of the plugs.

Another objective is to optionally provide a warning when the desired spark duration cannot be achieved due to excessive spark plug erosion. This will alert an operator that a specific spark plug has reached the end of it's useful life.

These and other objectives and advantages of the invention will become more apparent from the following detailed description when taken in conjunction with the accompanying drawings.

Briefly, the ignition system of the present invention includes means to determine the spark duration of each of the spark plugs as they fire, and means such as a PI or PID controller to modulate the amount of energy delivered to the energy storage element that supplies energy to the primary winding of the ignition coil, and thus modulates the energy delivered to the spark plugs, as a function of the difference between the desired spark duration and the measured spark duration. In the preferred embodiment, the ignition system also includes a spark duration setpoint adjustment programmable by the operator of the engine, and means to display and/or transmit the amount of energy required to sustain the desired spark duration for warning and diagnostic purposes.

In the preferred embodiment, the ignition system includes a microprocessor that is programmed to operate in a closed-loop mode of operation, to receive the system inputs including a spark duration setpoint signal and a signal that is indicative of the spark duration, to process the information, and to then provide output control signals to adjust the spark duration toward the desired duration.

Figure 1:
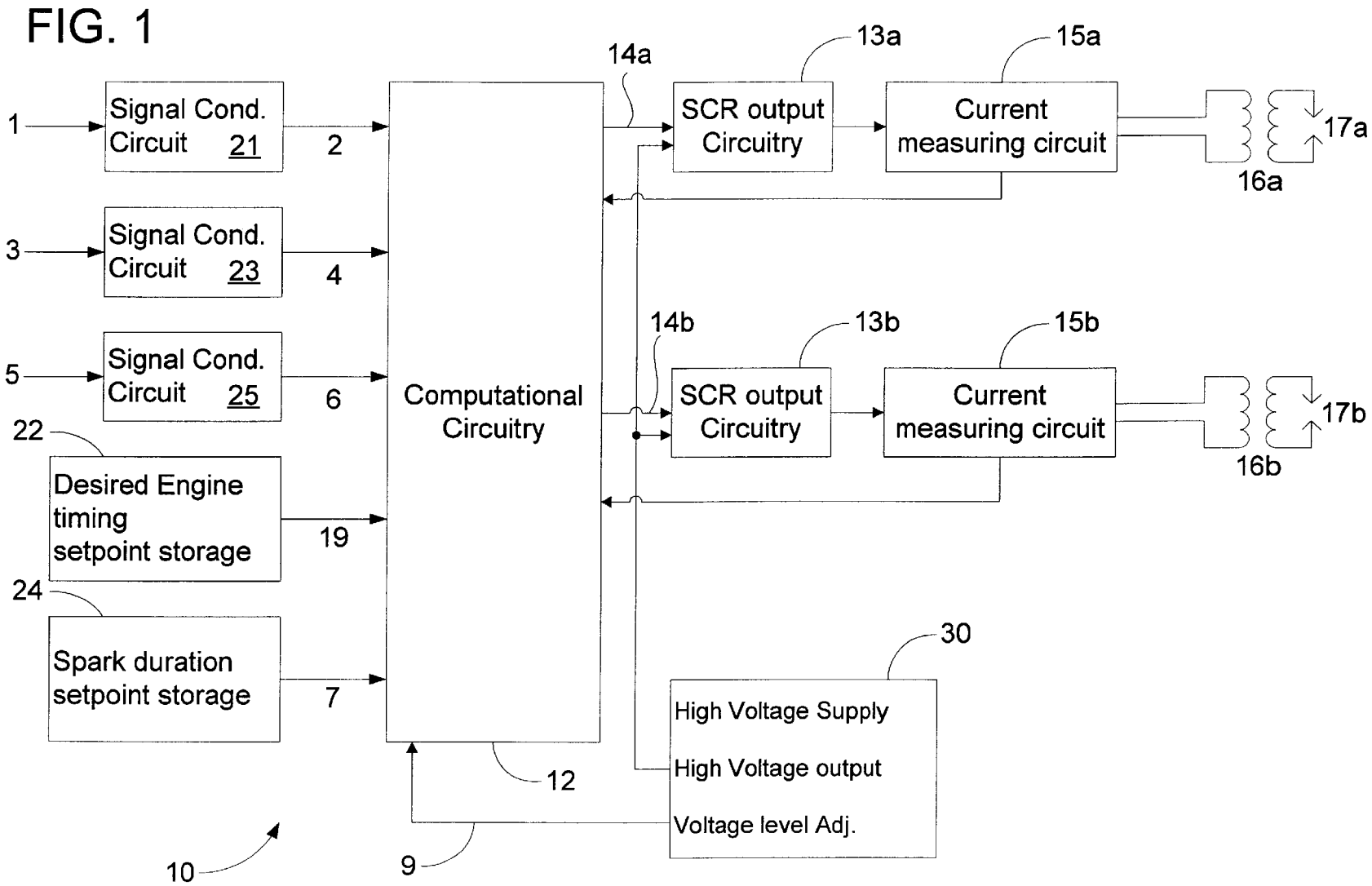
FIG. 1 is an overall schematic view of an ignition system for use with an internal combustion engine and incorporating the unique aspects of the present invention.

While the invention is susceptible of various modifications and alternative constructions, a certain illustrated embodiment has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE INVENTION

For purposes of illustration, the present invention is shown in the drawings as embodied in a capacitance discharge ignition system 10 (FIG. 1) suitable for use in internal combustion engine (not shown) and connected to an ignition coil 16A of the engine for supplying spark energy to a spark plug 17A in an engine cylinder. For illustration purposes, and with electrical components being shown in the drawings using conventional schematic symbols, the drawings depict two spark plugs, two ignition coils and two sets of associated circuitry, identified with the same reference numerals, but distinguished with the letter suffix "A" and "B". However, for purposes of the following description, it will be generally assumed that the two sets of coils, plugs and associated circuitry are identical, and thus, at certain times herein only the set identified with the letter "All may be described in detail, it being understood that in such instances the other set operates in an identical manner.

Figure 2:
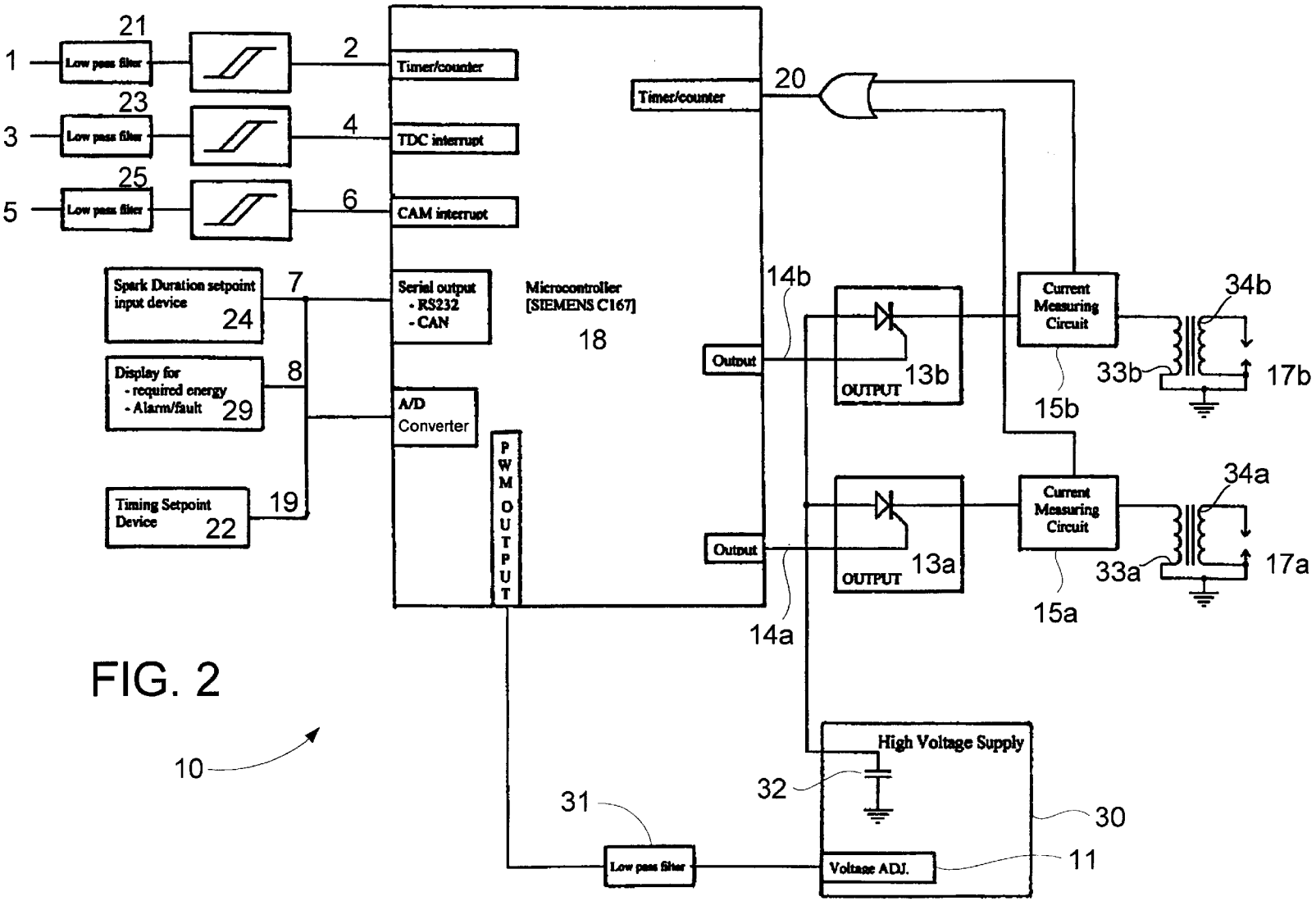
FIG. 2 is a schematic view of the ignition system of FIG. 1 but showing certain additional components and connections in greater detail.

Briefly, the ignition system 10 includes a high voltage power supply 30 including an energy storage capacitor 32 (FIG. 2) connected to provide energy to the primary windings 33A and 33B of ignition coils 16A and 16B, the power supply drawing power from an electric power source (not shown)and means depicted generally as computational circuitry 12 for controlling the timing and delivery of energy from the capacitor to each of the ignition coils. To this end, the ignition system is provided with input signals 1, 3, and 5 that are indicative of engine operating conditions engine speed, and timing. The signals 1, 3, and 5 are provided from engine condition sensors (not shown) such as variable reluctance sensors or other suitable sensors that generate voltage or current signals indicative of the engine condition being sensed. Signal conditioning circuits 21, 23 and 25, such as conventional circuits shown in FIG. 2 including a low-pass filter and schmitt trigger, accept and condition input signals 1, 3, and 5, and supply associated output signals 2, 4, and 6 as input signals to the computational circuitry 12 for processing with a timing setpoint signal 19 to achieve the desired timing and firing of the spark plugs. To accomplish its timing control function, the computational circuitry 12 typically includes means for processing signals 2, 4 and 6 to compute the engine speed and crankshaft position, and timing means to compute when the energy for the energy storage capacitor should be discharged, and to select the appropriate output circuitry 13A, 13B into which the energy from the energy storage capacitor 32 should be discharge for transmission to the associated ignition coil 16A, 16B.

Means for establishing or determining and storing the desired timing of the engine is generally indicated at 22. Typically, the timing setpoint, or desired timing for an engine or for a particular set of operating conditions is established from commands such as transmitted to the ignition system 10 through a predefined serial link protocol, and typically include an analog signal derived from a 4–20 milli-amp signal source, or other signal suitable for processing in the computational circuitry such as may be provided from predefined and stored timing schedules based on operating conditions, loading conditions, fuel and air temperatures, or other operating parameters, or from an analog signal derived from an operator adjusted apparatus such as a potentiometer, and a signal indicating the speed of the engine. These signals and commands are then processed and/or combined to generate a desired timing position setpoint signal 19 for the engine, the setpoint signal 19 being transmitted to the computational circuitry 12 for use in controlling energy delivery timing to the output circuitry and associated spark plugs.

In accordance with the present invention, the ignition system 10 is uniquely adapted to provide for a constant, desired spark duration in the spark plugs based on a spark duration setpoint that may be established to insure efficient combustion of the fuel/air mixture in the engine. More specifically, the system is adapted to continuously monitor the spark duration in each of the spark plugs, and modulate the energy in the energy storage capacitor 32, to adjust the energy delivered to each spark plug independently, until the desired spark duration is achieved at each plug for combustion of the fuel/air mixture. As a result, by providing a spark duration with sufficient, but not excess energy, desired combustion is achieved, and the useful life of the spark plugs is substantially enhanced as compared with the life of spark plugs used in conventional ignition systems set to supply excess energy to accommodate spark plug erosion and worst-case operating conditions.

Briefly, the computational circuitry 12 receives signals 20A and 20B that are either indicative or representative of the actual spark duration in each of the spark plugs 17A and 17B, and compares the actual spark duration in each plug with a spark duration setpoint signal to determine the error that exists between the desired and actual spark duration. With this information and the conditioned information 2, 4 and 6 from the sensors regarding engine operation, the timing setpoint signal 19, and the other system inputs, the computational circuitry adjusts and modulates the energy stored in the energy storage capacitor 32, or as shown, providing an output signal to modulate the energy to the capacitor to achieve the desired spark duration in each of the spark plugs independent of one another.

Means for receiving, establishing, storing and/or indicating the spark duration setpoint, or desired spark duration for the spark plugs and ignition coil type is indicated generally at 24 to provide the setpoint signal 7. This setpoint signal is provided to the computational circuitry 12 such as by the transfer through a serial link using, for example, an industry standard RS-232 signal or an industry standard CAN Bus. The setpoint signal is established based on operating factors such as actual or anticipated load on the engine, whether the engine is turbo-charged, the engine type, and whether the engine includes pre-combustion chambers, and may be initially set at the factory based on such considerations. This spark duration setpoint information, as well as the other information transferred to the computational circuitry 12 is stored in conventional non-volatile memory for data retention and subsequent processing purposes. Standard means such as a potentiometer, dip switches, pressure transmitter or temperature transmitter or other similar devices, may be used to provide spark duration setpoint information to the computational circuitry to establish the desired spark duration, such as to establish the setpoint based on or during actual operation, or for processing with and to trim a default setpoint previously set for the specific engine, thus enabling operator adjustment of the spark duration setpoint as operating conditions such as the fuel/air mixture temperature or ratio or load changes. Means 24 for establishing the spark duration setpoint alternately includes providing a signal indicative of, for example, fuel/air mixture ratio and/or temperature from the cylinder intake, and processor means for establishing the spark duration setpoint therefrom, and/or adjusting the setpoint based on changes therein. Since a leaner fuel/air mixture requires a longer spark duration to insure proper combustion, automatically adjusting the setpoint in this manner reduces the likelihood of misfiring on the change of such conditions.

The ignition system 10 is provided with means for detecting spark duration in each of the spark plugs and generating the spark duration signals 20A, 20B. The spark duration may be either measured or derived using any number of known techniques, such as by measuring the actual spark duration from the voltage waveform of the secondary ignition coil winding with an apparatus indicated at 26, or, for example, by measuring an electrical characteristic of the primary winding of the ignition coil.

By way of example, the spark duration could be measured directly using a high voltage probe, similar to a TEXTRONIX P6015A probe attached to suitable means to measure the output, compute the spark duration, and provide such computational information to the computational circuitry for further processing pursuant hereto, such means as may be found in most commercially available oscilloscopes. In this instance, however, the associated cost will likely be relatively expensive. Alternately, for example, the spark duration could be measured from an electrical tap into the spark plug wire.

Figure 3:
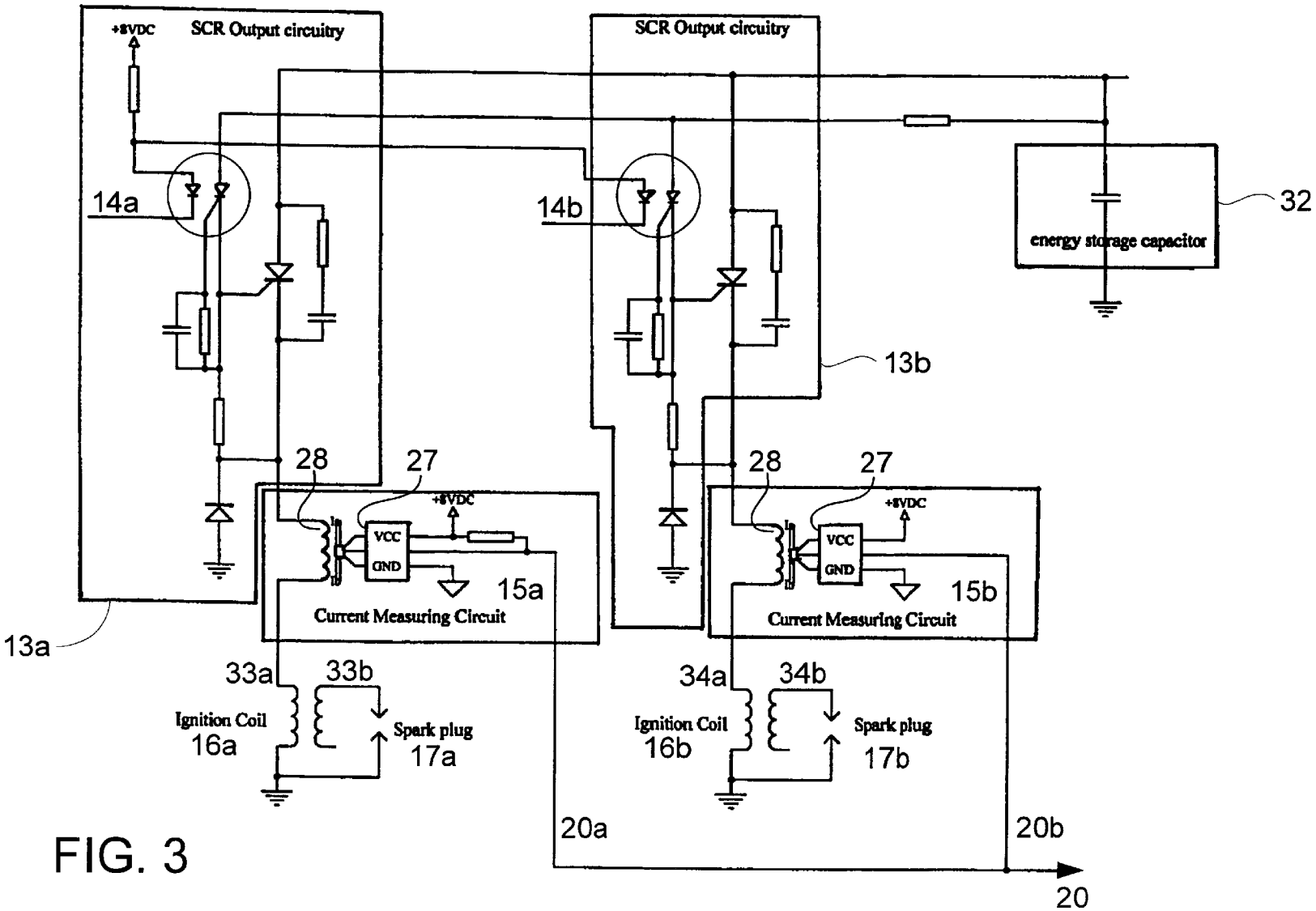
FIG. 3 is a schematic view of certain parts shown in detail of the ignition system.

In the embodiment shown, a signal that is indicative of the spark duration is provided by measuring the electrical characteristics of the primary side of the ignition coils 16A, 16B, and the actual spark duration or a signal representative thereof is then computed from these signals. In particular, the primary current in the ignition coil is used to generate a signal indicative of spark duration. In this instance, the current measuring circuits 15A, 15B include conventional means to measure the time that the current in the primary winding 33A, 33B of the ignition coils is above a predefined threshold to establish the spark duration. In the preferred embodiment, a hall-effect sensor 27 (FIG. 3) is used in conjunction with a toroidal winding 28 with an air gap to generate a pulse width (PW) signal that corresponds to the time that the primary current is above said threshold. In the embodiment shown, one current measuring circuit is utilized for each of the ignition coils. In other embodiments one current measuring circuit could be used for all ignition coils. One suitable hall effect sensor is an ALLERGRO 3121. The use of a hall-effect sensor in conjunction with a toroidal winding in this manner is well known and is shown in ALLERGO's application notes, and in the present instance, offers a high degree of electrical isolation and is noninvasive. Other known means are also available for use in connection with the present invention to establish the spark indicative signal such as measuring the primary current using a sense resistor circuit.

The output circuitry 13A, 13B of the ignition system 10 includes means to selectively establish an electrically conductive path between the energy storage capacitor 32 and the ignition coils 16A, 16B. This circuitry may be of a conventional-type construction, and in the embodiment shown, includes a silicon controlled rectifier (SCR), with the gate of the SCR being controlled by an output signal from the computational circuitry 12, and with one output circuit is used for each ignition coil.

In carrying out the invention, the computational circuitry 12 includes means to modulate the amount of energy stored in the energy storage capacitor 32 of the high voltage power supply 30, means to transform the signal indicative of the spark duration to actual spark duration or a signal representative thereof, means to compute the error or difference between the desired spark duration and the actual spark duration, means to compute a new energy level for the next cycle for that spark plug based on the difference between the desired spark duration and the actual spark duration and the current energy level, and means such as a PI (proportional-integral) or PID (proportional-integral-derivative) control algorithm to compute and control said change in energy level.

Derived relationships exist for the embodiment shown between the pulse width (PW) from the spark duration measuring circuit 15, the spark plug demand voltage ($V_{kv}$), and the actual spark duration (SD). In the preferred embodiment shown, the relationships are:

$V_{kv}=m_2(E,C)*SD+b_2(E,C)$(derived from the operational characteristics of a standard ignition coil)

$V_{kv}=m_1(E,C)*PW+b_1(E,C)$(derived from the characteristics of the current measuring circuit 15 shown)

where:

E is the energy delivered to the ignition coil;

C is a constant based on the type of ignition coil;

$m_1(E,C)$ is the slope of the line between PW and $V_{kv}$, and as indicated, is a function of the energy delivered to the ignition coil and the type of coil; $m_2(E,C)$ is the slope of the line between SD and $V_{kv}$, and as indicated, is a function of the energy delivered to the ignition coil and the type of coil;

$b_1(E,C)$ is the constant of a line between PW and $V_{kv}$, at a specific energy, and as indicated, is a function of the energy delivered to the ignition coil and the type of coil; and $b_2(E,C)$ is the constant of a line between SD and $V_{kv}$, at a specific energy, and as indicated, is a function of the energy delivered to the ignition coil and the type of coil.

Combining the above two derived relationships results in the following relationship for the actual spark duration based on the pulse width provided by circuit 15A, 15B:

$$SD=[m_1(E,C)/m_2(E,C)]*PW+[b_1(E,C)/b_2(E,C)]$$

Thus, in this instance, the spark duration is a function of the coil configuration and the energy supplied to the ignition coils. And although this relationship has been developed between the actual spark duration and the pulse width of the circuit 15A, 15B, and is utilized herein for purposes of further discussion, it is noted that, when utilizing a different method for providing a spark duration indicating signal, the computational relationship for the actual spark duration will likely be different. For example, circuitry providing the signal indicative of the spark duration could be selected such that SD=PW, or for other desired mathematical relationships. The exact relationship will be a function of the specific means utilized to measure directly or indirectly the spark duration of the spark plugs.

Figure 4:
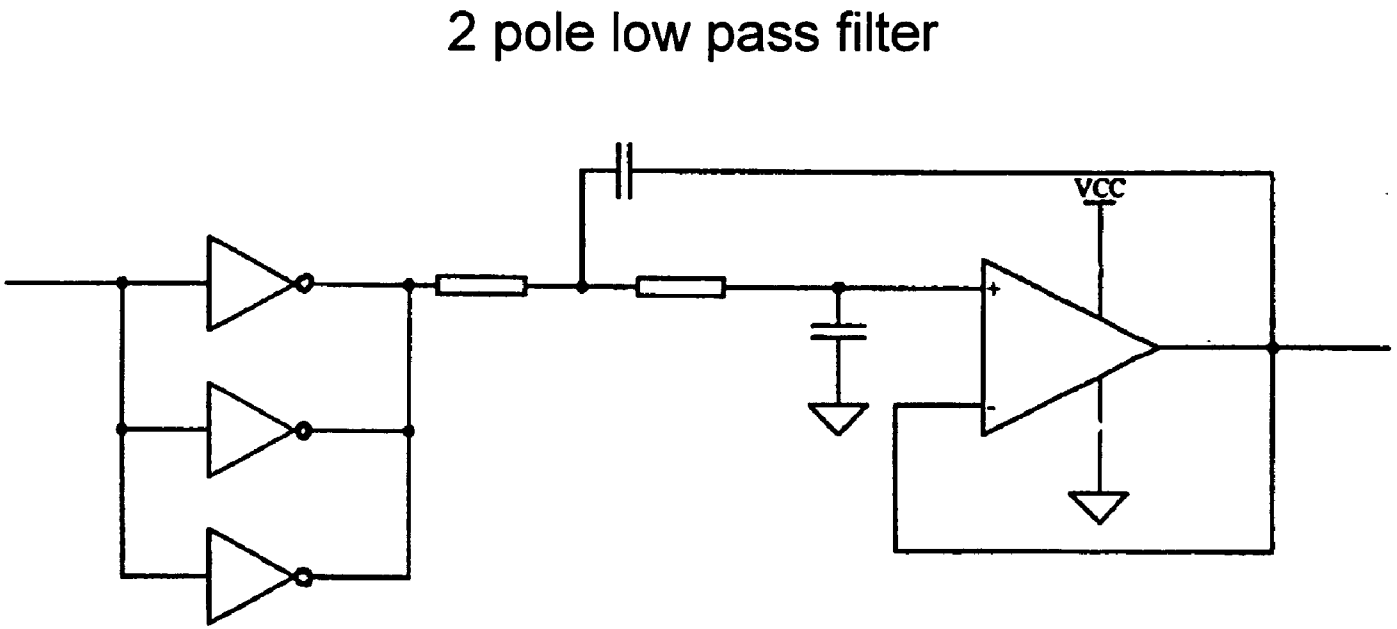
FIG. 4 is a schematic view of a conventional 2-pole low pass filter used in the ignition system.

In the preferred embodiment a microcontroller 18 (FIG. 2) is used in the computational circuitry 12, rather than other conventional electrical components, to receive and process the signal inputs, and to control the voltage and energy delivered to the storage capacitor 32, and thus, the energy delivered to each spark plug. In the embodiment shown, a SIEMENS C 167 microcontroller is used, and the control algorithms are implemented via conventional software programming techniques. Advantageously, utilizing a microcontroller provides for integral counters and timers for ignition system control and timing functions and spark duration measurement. The microcontroller mentioned also includes a Pulse Width Modulated (PWM) output which is configured in the embodiment shown as the output to a voltage control device 11 that controls the voltage level of the high voltage power supply to control the energy stored in the capacitor 32. In this instance, the PWM output signal 9 is converted to a control voltage to the device 11 by means of a low-pass filter 31, such as the conventional 2-pole low pass filter shown in FIG. 4, an industry standard digital-to-analog converter, or other suitable means to accomplish this function.

Figure 5:
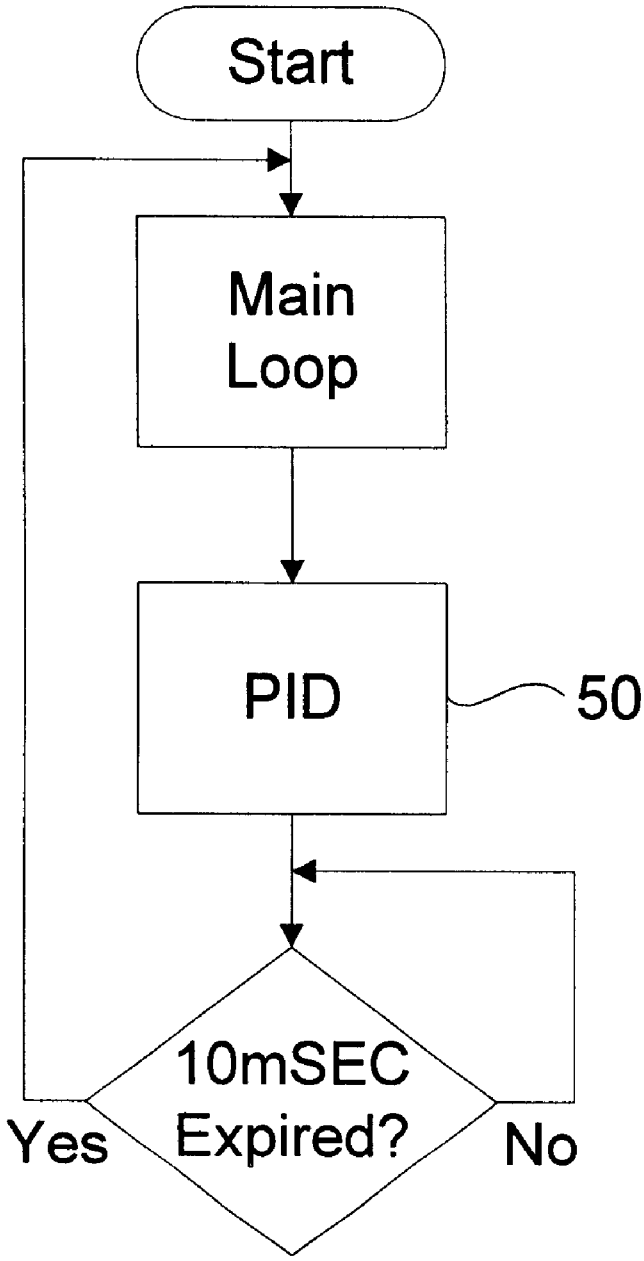
FIG. 5 is a flow diagram generally depicting the main control logic utilized in a processor of the ignition system.
Figure 6:
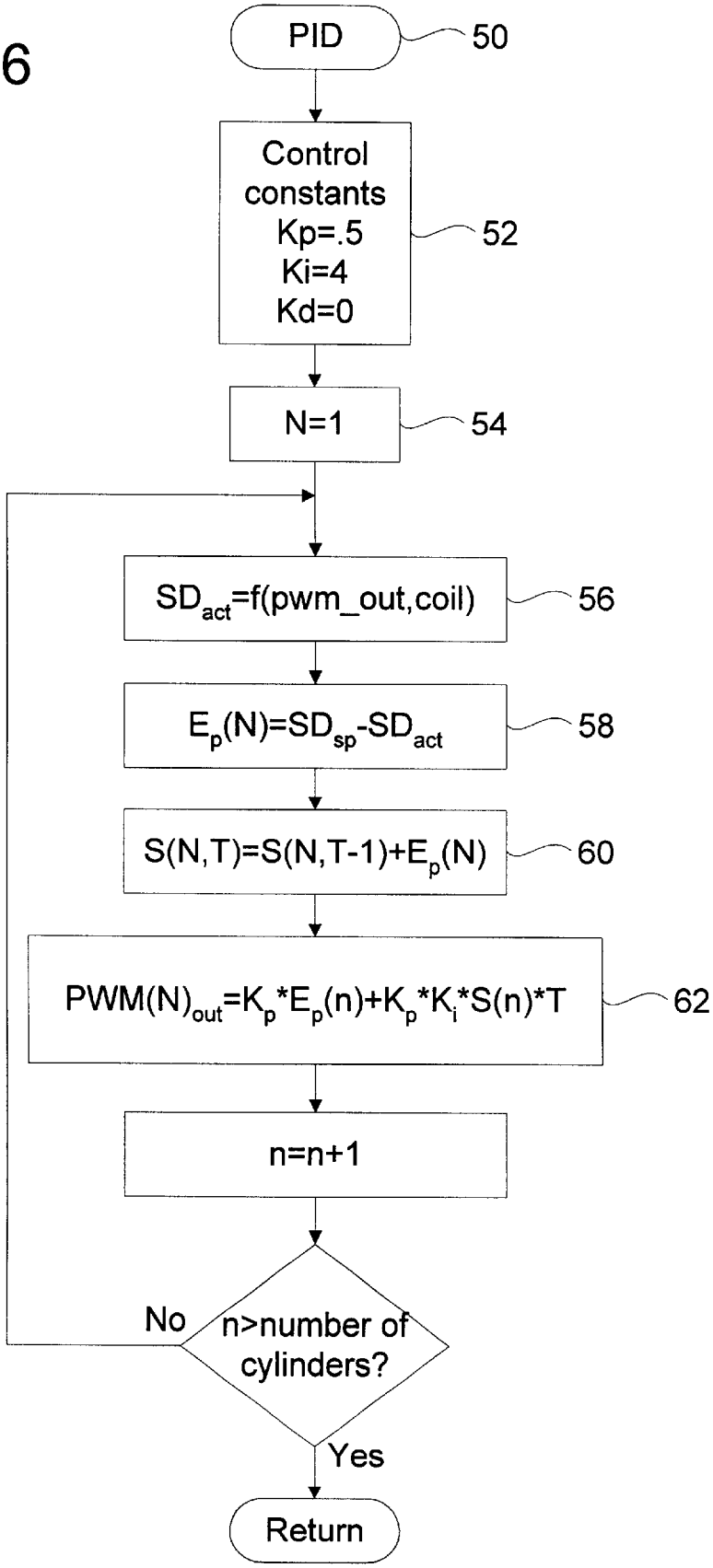
FIG. 6 is a flow diagram generally depicting certain aspects of the control logic of a PID controller suitable for use in the ignition system.
Figure 7:
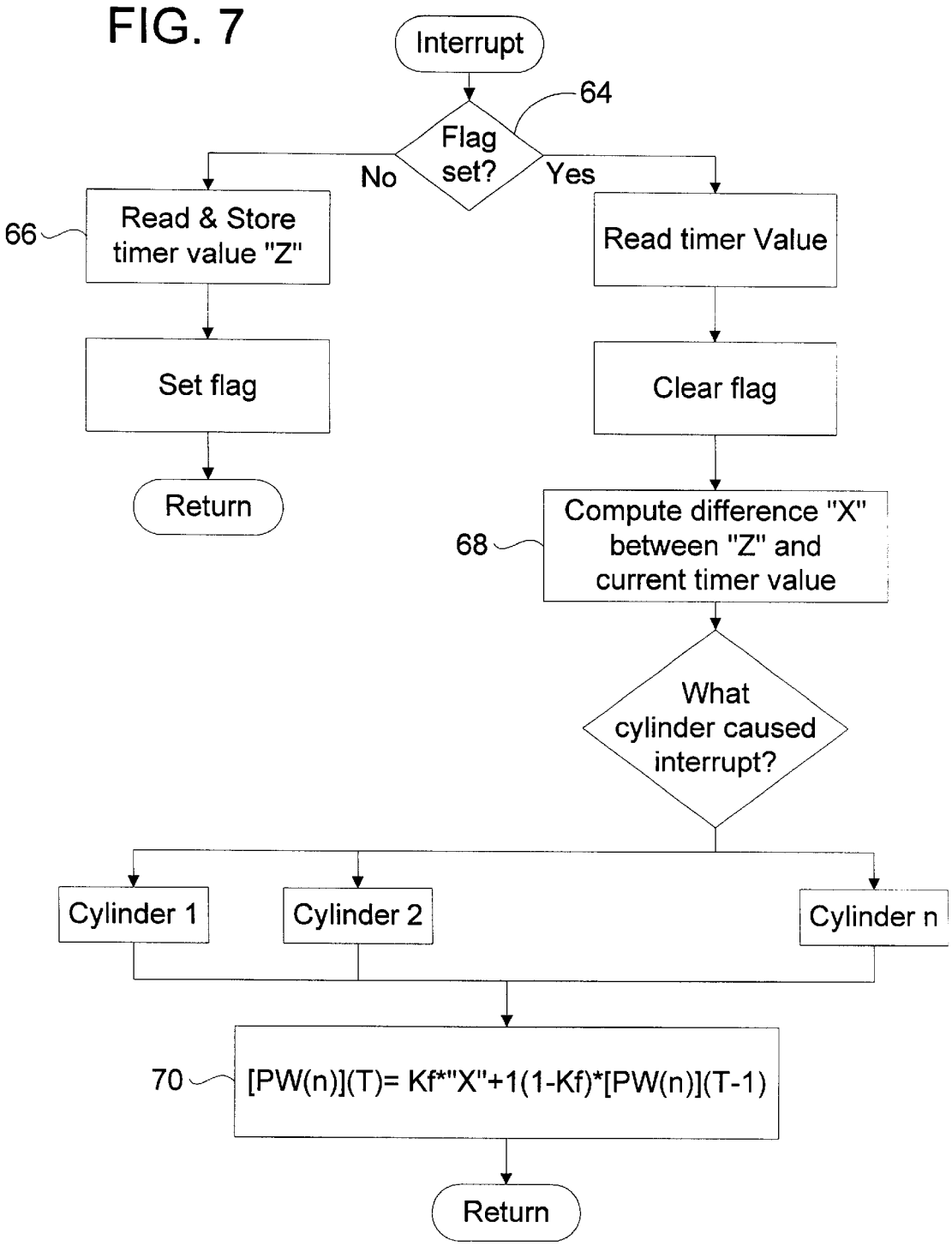
FIG. 7 is a flow diagram generally depicting certain aspects of an interrupt procedure performed by the processor during control of the ignition system.
Figure 8:
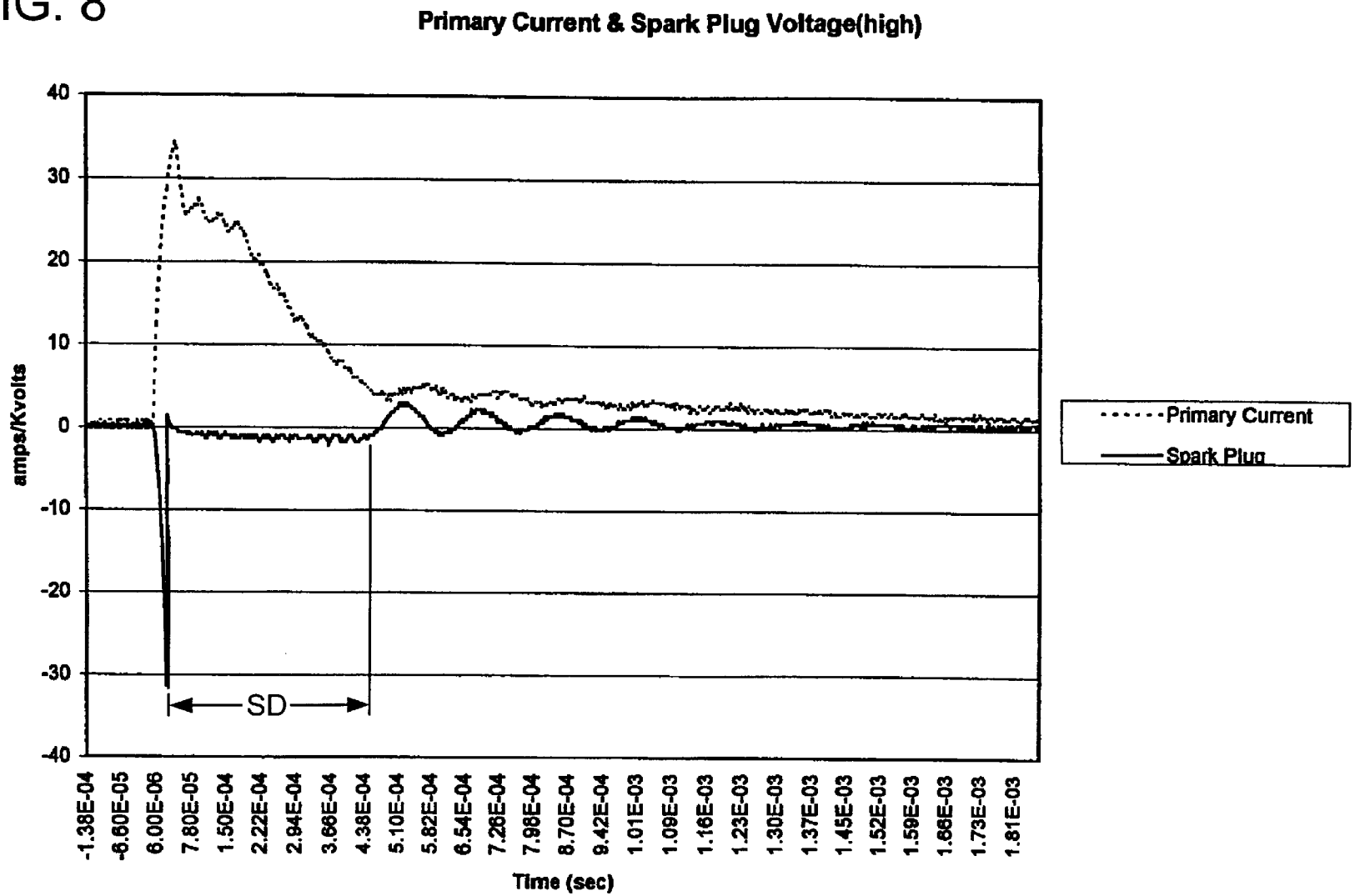
FIG. 8–11 are sample traces taken from an ignition system according to the present invention.
Figure 9:
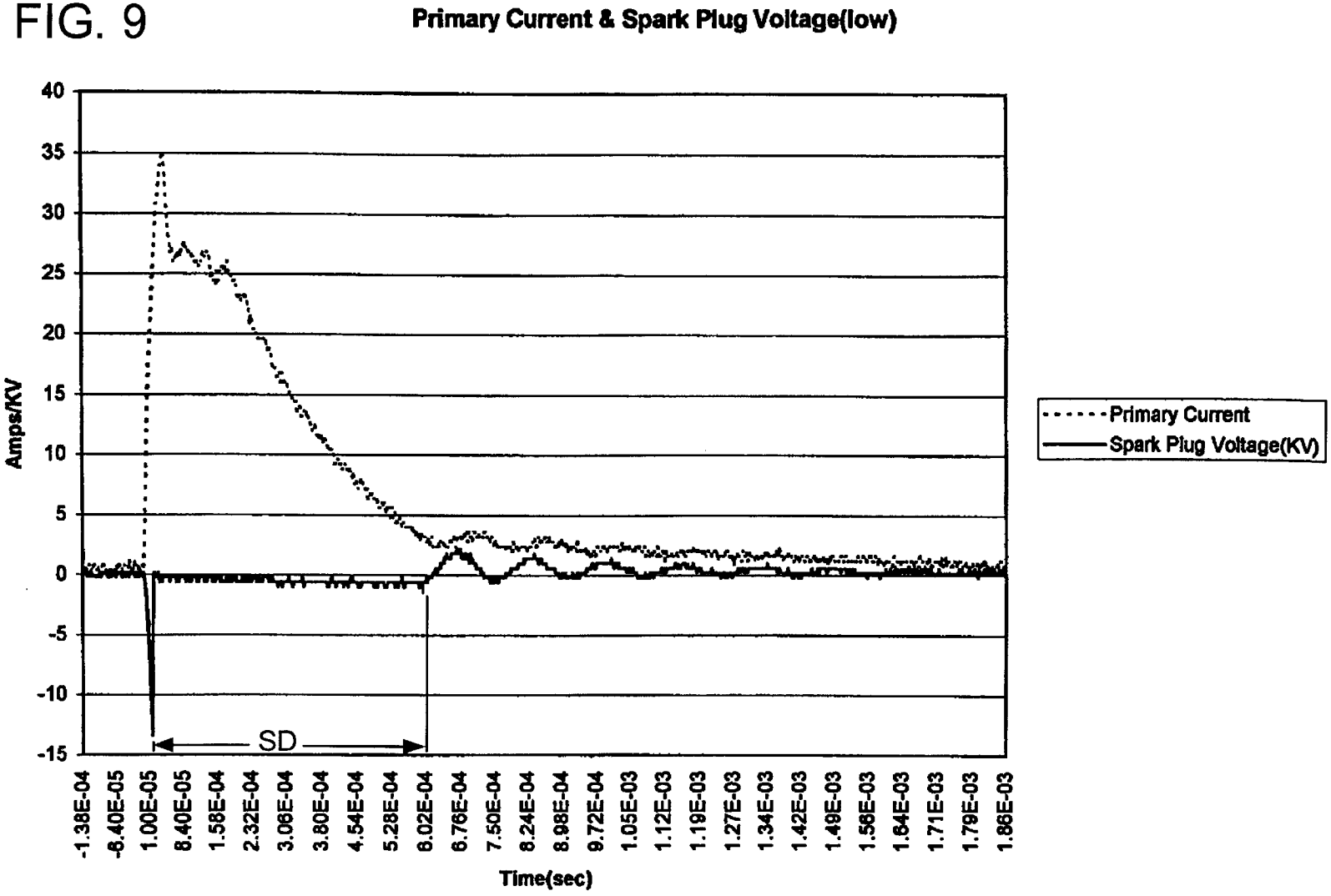
Figure 10:
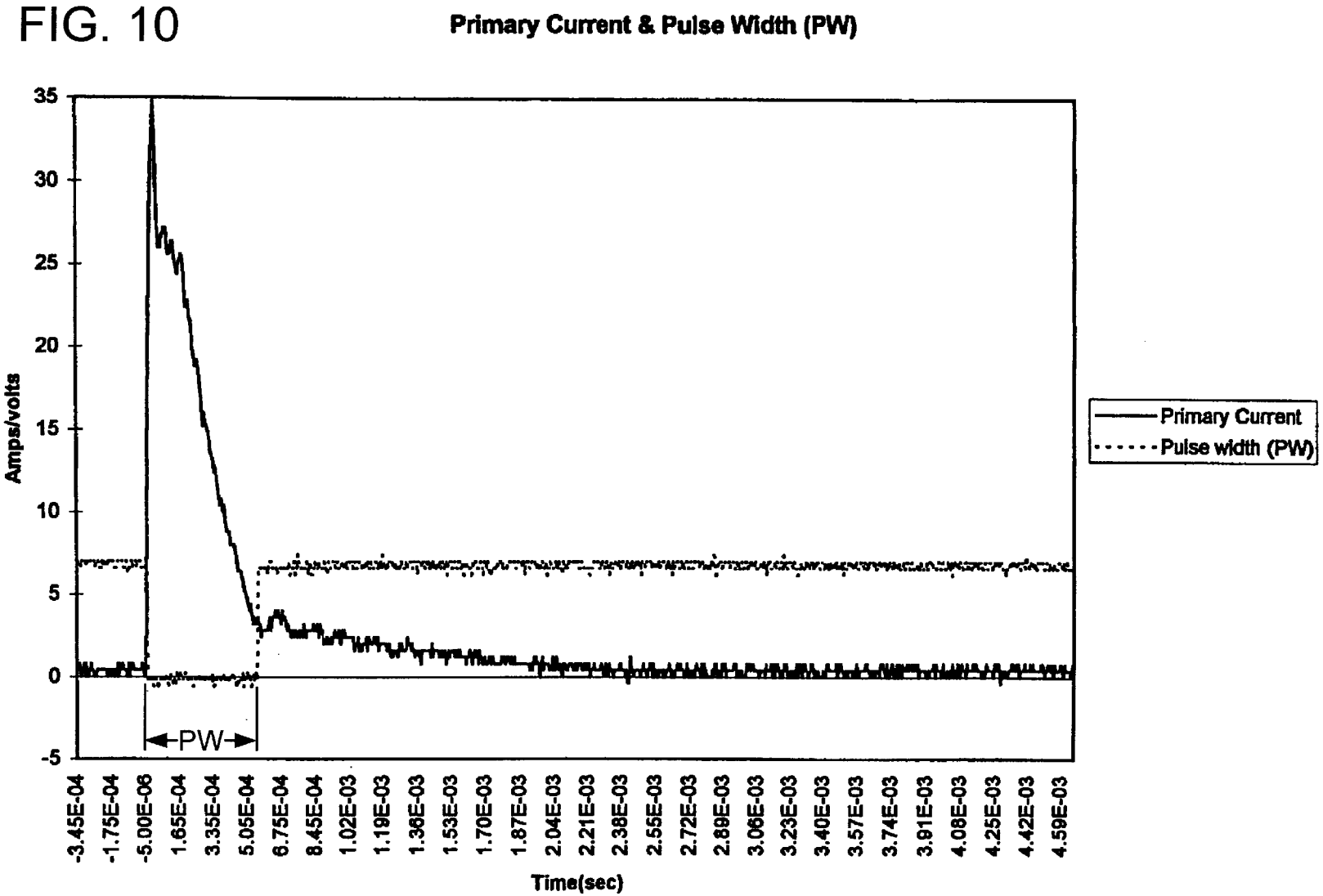
Figure 11:
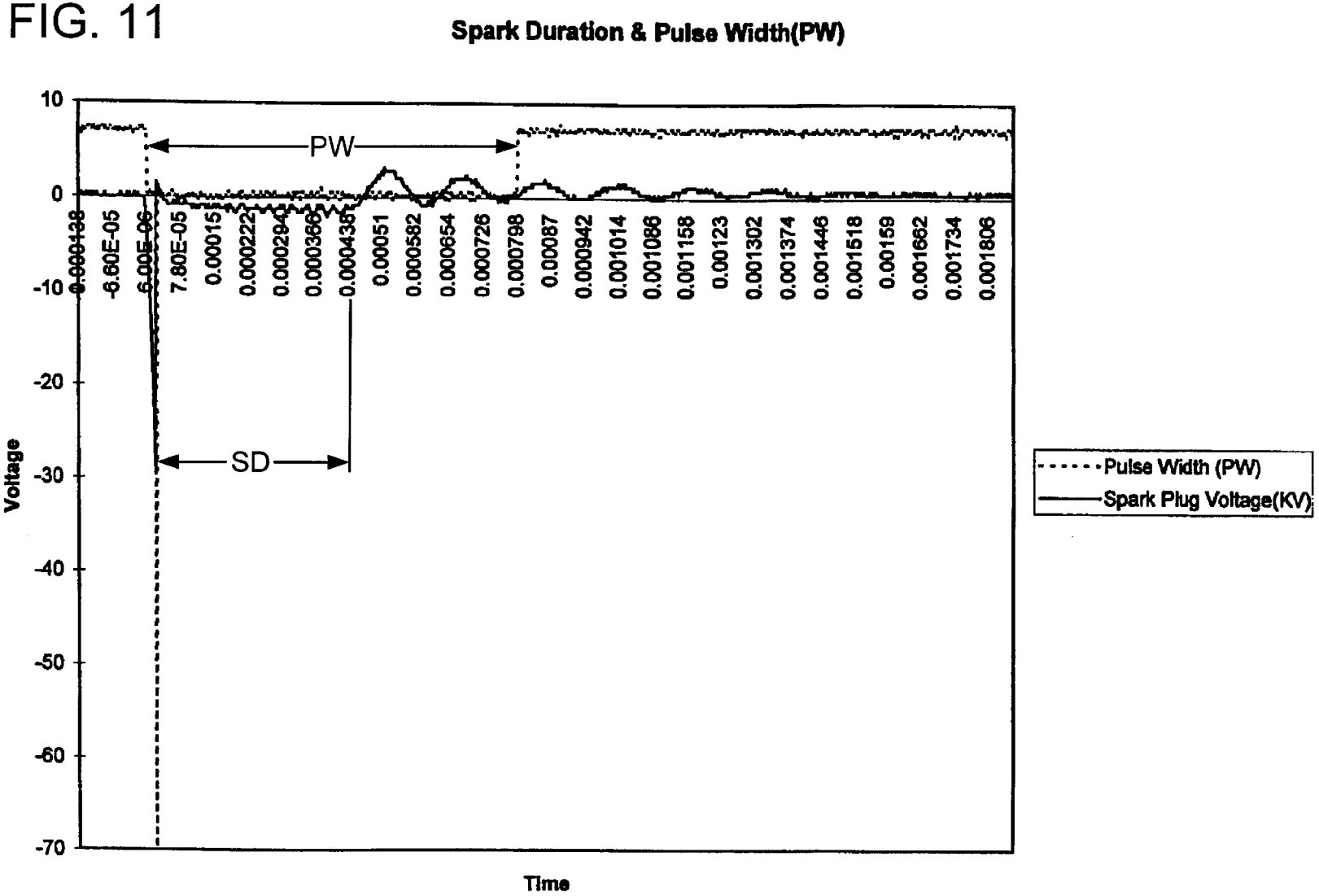

A general implementation of a microprocessor-based PID controller for the ignition system 10 is illustrated in flow charts in FIGS. 5–7. In this instance, the controller executes through the main control loop at convenient intervals for the engine such as every 10 milliseconds as indicated in FIG. 5, and includes "house-keeping" chores and computations where timing is not critical such as calculating engine speed and checking for over-speed conditions.

FIG. 6 illustrates the general aspects of a PID controller implementation according to the invention. In this instance:

$K_d$ is the controller "derivative" constant $K_i$ is the controller "integration" constant $K_p$ is the controller "proportional" constant N (or n) is number of cylinders (assuming one spark plug or one "firing" per cylinder)

$SD_{act}$ is actual spark duration $PWM_{out}$ or $PWM_{out}(n)$ is the on-time of the pulse width modulated output of the microcontroller for cylinder/plug n $E_p$ is the calculated error between the desired spark duration and the actual spark duration $SD_{sp}$ is spark duration set point f(x,y,z) denotes "function" of parameters "x", "y", and "z"

$K_f$ is filter constant used in digital filtering $P_w$ is pulse width

S is result of rectangular integration

T is time

As indicated at 52 and 54, the PID controller loop 50 is initialized at N=1 and provided with the controller constants $K_d$ $K_i$ and $K_p$ such as from software initialization or ROM storage in the processor. As indicated at 56, 58 and 60, the spark duration $SD_{act}$ is computed from the spark duration indication or pulse width signal for the cylinder N=1, the error between the actual spark duration and the spark duration setpoint is computed, and the error integrated through numerical technique such as rectangular integration. In this instance, the actual spark duration $SD_{act}$ is computed as a function of the pulse width PW and the parameters $m_1$, $m_2$, $b_1$, and $b_2$, and more particularly, the specific coil configuration C and the energy E supplied to the coil, such energy being a function of $PWM_{out}$, the coil configuration input information having been provided from, for example, tabulated data stored in the processor on the ignition coil type characteristics, or provided as an operator selected or provided input to the system. Finally, the desired pulse width modulated output associated with the cylinder for the next engine cycle is computed utilizing the result of the integration and the controller constants as indicated at 62, thus establishing the desired energy level to be supplied to the ignition coil for that cylinder. This process is then repeated for each of the cylinders. It is noted that in FIG. 6 the focus is on the proportional and integral portions of the controller logic ($K_d$ being shown set equal to zero) since the integration removes the steady state errors and erosion of the spark plug electrodes generally occurs relatively slowly, but that the derivative control function will be implemented (i.e., $K_d$ having a value greater than zero) in those instances where a quicker response time is a desired.

FIG. 7 generally illustrates a means for implementing interrupt driven computation of the pulse width or spark duration indicative signal from each spark plug/cylinder location. A separate loop may be provided for each cylinder, or preferably, the software is written to track the data for each cylinder. The routine of FIG. 7 is entered into every time there is a transition on the "wired-or'd" outputs from the primary current measuring circuits 15A, 15B. The interrupt is both negative and positive edge triggered. The first transition for each cylinder is negative. When this occurs, as determined by the flag indicated at 64 not being set, the value "Z" of a free-running timer is read and stored as indicated at 66, and the flag is then set in the processor. The next transition for the cylinder is positive. Upon responding to this interrupt, the current value of the free running counter is again read, the value of which is compared to the value "Z" stored from the negative transition. This difference "X" is the pulse width (PW) for the spark plug/cylinder that caused the interrupt. As indicated at 70, the pulse width data is then filtered and stored for that cylinder for computation of the actual spark duration as previously described.

With the foregoing arrangement, as the spark plug erodes, tending to result in reduced spark duration, the microprocessor will compensate by providing additional energy to maintain the spark duration for combustion of the fuel/air mixture. Similarly, the ignition system responds to a change in load, which tend to cause a change in the spark duration, by adjusting the energy supplied to the plug to maintain the desired duration.

For illustrative purposes, sample traces taken from an ignition system according to the invention and pursuant to the description herein are shown in FIGS. 8–11. Tabulated data generated from such traces for a specific ignition coil type results in the input data regarding "m" and "b" necessary for computation of the actual spark duration from the pulse width signal.

In the preferred embodiment, an output signal 8 from the computational circuitry-microprocessor is provided for information regarding the energy levels being delivered to each spark plug on a real-time basis, and optionally to convey any of the other information that is being received and/or processed in the computational circuitry, for information and diagnostic purposes. In this instance, communication means 29 receives the signal 8 and communicates the energy level provided to each spark plug, such means being selected for suitability for the intended use of the information. For example, the communication means may include a stand alone alpha-numeric display, a display built into the ignition system, or the information may be transmitted to a display terminal or a PC to be display on the monitor of the PC. The display can be analog, similar to a bar graph or a number that represents the amount of energy, or other display suitable for the intended use of the information. The information display means may enable the operator to manually adjust the ignition system parameters such as the spark duration setpoint in those embodiments that provide for manual adjustment. The communication means connected to signal 8 may be configured to alert the operator to certain ignition faults such as caused when the ignition system cannot achieve the desired spark duration for a predefined energy level due to excessive electrode erosion, faulty ignition wiring, defective ignition coil, or fouled or shorted spark plug, and thus warning the operator that the spark duration can no longer be maintained for normal engine operation. Warnings from communication means 29 could be as simple as a line superimposed across a bar graph that signals that if the bar graph is above this line, a fault exist or an output could be energized if the required energy to maintain the desired spark duration exceeds a predefined limit, an audible alarm, a light source, a message transmitted over the serial link or other means adapted to alert the operator of a failure condition.

Those skilled in the art will appreciate that ignition systems adapted to control the spark duration may be provided that embody one or more modifications while remaining within the scope of the present invention. In addition to such modifications mentioned above, for example, the specific control logic implementation and associated control parameters in the computational circuitry/microprocessor will depend on the means utilized to effect determination of a signal indicative of the spark duration or the actual spark duration signal, and to control the spark duration. The present invention will work with, or can be incorporated into, any basic-type of ignition system, including as a separate, add-on controller unit to existing engines. Although the ignition system 10 is shown in connection with input signals 1, 3 and 5, an ignition system according to the present invention is equally suitable for use with engines or ignition systems provided with a variety of engine condition sensor arrangements and associated input signals. Example of such common sensor arrangements include: arrangements that sense engine position using one sensor, the sensor being typically mounted to sense events or holes on a trigger wheel mounted on the crankshaft or camshaft; two sensor arrangements in which one sensor senses the rotation of the flywheel by counting the number of teeth or holes drilled in the fly-wheel, and in which a second sensor in mounted on the camshaft to indicate top-dead-center (TDC) of a 4-stroke engine or on the crankshaft on a 2-stroke engine; or three sensor arrangements such as with one sensing the teeth or holes on the flywheel, one sensor mounted to sense TDC on the crankshaft, and one sensor mounted on the camshaft to sense a single event which determines which cycle of a four stroke engine, i.e., the exhaust or the compression stroke, that the engine is in. Each of these arrangements, as well as others, are intended to provide the ignition system with information as to engine timing and actual operation, and may be accommodated within the present invention as input signals that are suitably processed to accomplish the intended timing purposes. The ignition system 10 may be provided with other inputs such as regarding fuel/air mixture temperature or ratio, and engine over-speed information, for appropriate processing in accordance herewith. In addition, although only two sets of coils, plugs and associated circuitry are shown, it will be apparent that an ignition system according to the invention is equally suitable for use with engines provided with addititional ignition coils and spark plugs, as well as engines provided with a single ignition coil for supplying multiple spark plugs, or engines equipped with non-identical coils, plugs and/or associated circuitry. The present invention is also suitable for use in inductive-type ignitition systems in which the energy supplied to an power-supply inductor is controlled to achieve spark duration control.

From the foregoing, it will be apparent that the present invention brings to the art a unique ignition system which, by virtue of providing means to modulate the energy stored in the storage capacitor, or other energy storage element such as inductors used in inductive type ignition systems, to control the spark to a desired duration, the operating life of spark plugs is enhanced over prior ignition systems

What is claimed is:

1. A capacitance discharge ignition system of the type comprising a spark plug; an ignition coil having a primary winding, and having a secondary winding connected to the spark plug; an energy storage capacitance element connected to the primary winding of the coil; a power supply connected to the energy storage capacitance element; and timing means for controlling the timing of the discharge of the energy storage capacitance element to the primary winding to effect generation of a spark in the spark plug; the ignition system being characterized by further comprising:

means for setting a first signal indicative of a desired setpoint for spark duration in the spark plug;

means for providing a second signal indicative of the actual spark duration based on current flowing through the primary winding;

means for determining an error signal between said first and second indicative signals; and means for modulating the energy delivered to the energy storage capacitance element as a function of said error signal so as to adjust the actual spark duration toward the desired spark duration.

2. An ignition system as defined in claim 1 in which said first indicative signal is a desired spark duration setpoint.

3. An ignition system as defined in claim 2 in which said setting means includes automated input means for storing said first signal in permanent memory.

4. An ignition system as defined in claim 2 in which said setting means includes automated input means for establishing a second desired spark duration setpoint, and manually operable means for trimming the second setpoint to the first setpoint.

5. An ignition system as defined in claim 1 in which said providing means includes means for sensing the current through the primary winding of the ignition coil.

6. An ignition system as defined in claim 1 in which said providing means includes means for directly measuring the spark duration.

7. An ignition system as defined in claim 1 in which said determining means includes processor means (i) receiving said first and second indicative signals, (ii) operative to compute said error signal therefrom, and (ii) operative to provide a control signal to said modulating means, said modulating means being responsive to modulate the energy delivered to the energy storage unit in response thereto.

8. An ignition system as defined in claim 7 further comprising means receiving said second indicative signal for generating a signal representative of the actual spark duration, said processor means being operative to convert said first indicative signal into a signal representative of the desired spark duration, said processor means being further operative to compute the difference between said signal representative of the desired spark duration and said signal representative of the actual spark duration.

9. A capacitance discharge ignition system of the type comprising a spark plug; an ignition coil having a primary winding, and having a secondary winding connected to the spark plug; an energy storage capacitance element connected to the primary winding of the coil; a power source connected to the energy storage capacitance element; and timing means for controlling the timing of the discharge of the energy storage capacitance element to the primary winding to effect generation of a spark in the spark plug; the ignition system being characterized by further comprising:

means for establishing a setpoint signal indicative of the desired spark duration;

electrical sensing means operatively connected for sensing an ignition system electrical characteristic indicative of the actual spark duration and operative to provide an output signal indicative thereof;

processor means receiving said setpoint signal and the output signal from said electrical sensing means, said processor means being adapted to (i) determine the difference between the setpoint signal and said output signal, and (ii) modulate the energy delivered to the energy storage capacitance element as a function of said difference to adjust the actual spark duration toward the desired spark duration.

10. A controller to control the spark duration of at least one spark plug in a capacitance discharge ignition system having an ignition coil connected to the spark plug, the ignition coil having a primary winding, the primary winding connected to an energy storage element, the controller comprising:

a first module that outputs a desired spark duration of the spark plug based upon parameters received from an external source;

a second module that outputs a spark duration based on a current flowing through the primary winding of the ignition coil;

a calculation module that receives the desired spark duration and the spark duration and that outputs an error signal from a difference between the desired spark duration and the spark duration;

a first output module that receives the error signal and modulates energy delivered to the energy storage element as a function of the error signal to adjust the spark duration; and a second output module that controls the timing of the discharge of the energy storage element to the primary winding to effect generation of a spark in the spark plug.

11. The controller of claim 10 wherein the ignition system further comprises a power source connected to the energy storage element and the output module and wherein the first output module modulates energy delivered to the energy storage element by controlling a voltage level of the power source.

12. The controller of claim 10 wherein the energy storage element comprises a capacitor and the output module modulates energy delivered to the capacitor.

13. The controller of claim 10 wherein one of the second module and the calculation module determines if the ignition system cannot achieve the desired spark duration for a predefined energy level delivered to the primary winding and wherein the controller further comprises an alarm connected to the spark duration module that provides an alert if the ignition system cannot achieve the desired spark duration for a predefined energy level delivered to the primary winding.

14. The controller of claim 10 further comprising a current sense module connected to the primary winding and wherein the second module determines a spark duration from the current flowing through the primary winding by: determining a first time instance when the current rises above a threshold; determining a second time instance when the current falls below the threshold; and setting the spark duration as a function of a difference between the first time instance and the second time instance.

15. The controller of claim 14 wherein second module sets the spark duration as a function of a difference between the first time instance and the second time instance by setting the spark duration to the difference between the first time instance and the second time instance.

16. A controller for controlling spark duration in at least one spark plug in a capacitance discharge ignition system, the ignition system having an ignition coil having a primary winding and a secondary winding, an energy storage element and a power source connected to the primary winding, the secondary winding connected to the spark plug, the controller comprising:

an input setpoint module that receives parameters for determining a spark duration setpoint of the spark plug;

a spark duration module that determines the spark duration;

a calculation module that receives a first input from the input setpoint and a second input from the spark duration module and computes an energy level setpoint based on a difference between the spark duration setpoint and the spark duration;

an output module that receives the energy level setpoint and delivers an amount of energy equivalent to the energy level setpoint module to the primary winding from one of the energy storage element and the power source.

17. The controller of claim 16 further comprising an adjustment output module to modulate the energy delivered to the energy storage element to the energy level in order to adjust the spark duration.

18. The controller of claim 17 further comprising a current sense module to sense current flowing through the ignition coil and wherein the current sense module provides a current input to the spark duration module for determining the spark duration based on the current flowing through the ignition coil.

19. The controller of claim 17 further comprising a current sense module to sense current flowing through the primary winding and wherein the current sense module provides a current input to the spark duration module for determining the spark duration based on the current flowing through the primary winding.

20. The controller of claim 17 wherein one of the spark duration module and the calculation module determines if the ignition system cannot achieve the desired spark duration for a predefined energy level delivered to the primary winding and wherein the controller further comprises an alarm connected to the one of the spark duration module and the calculation module that provides an alert if the ignition system cannot achieve the desired spark duration for a predefined energy level delivered to the primary winding.

* * * * *